United States Patent [19]

Ozeki

[11] Patent Number: 5,069,648

[45] Date of Patent: Dec. 3, 1991

[54] SAILING BOAT MODEL ADAPTED FOR EXHIBITION AND FOR SAILING ON THE WATER

[75] Inventor: Jiro Ozeki, Tokyo, Japan

[73] Assignee: Slidex Corporation, Tokyo, Japan

[21] Appl. No.: 605,375

[22] Filed: Oct. 30, 1990

[30] Foreign Application Priority Data

Jul. 10, 1990 [JP] Japan ..... 2-181744

[51] Int. Cl.[5] ..... A63H 23/02

[52] U.S. Cl. ..... 446/160; 114/140; 114/164

[58] Field of Search ..... 446/163, 160; 114/140, 114/141, 162, 164

[56] References Cited

U.S. PATENT DOCUMENTS

| | | | |
|---|---|---|---|
| 685,648 | 10/1901 | Schoenhut | 114/141 |
| 1,918,543 | 7/1933 | Hoffman | 446/163 |
| 3,381,648 | 5/1968 | Vonck | 114/141 X |
| 3,871,127 | 3/1975 | Heath | 446/163 |
| 4,548,149 | 10/1985 | Del Roso | 114/162 |

FOREIGN PATENT DOCUMENTS

| | | | |
|---|---|---|---|
| 443786 | 5/1927 | Fed. Rep. of Germany | 446/160 |
| 413930 | 7/1934 | United Kingdom | 446/160 |

*Primary Examiner*—Mickey Yu

*Attorney, Agent, or Firm*—Fleit, Jacobson, Cohn, Price, Holman & Stern

[57] ABSTRACT

A sailing boat model adapted for exhibition and for actual sailing on water includes a hull, a keel provided on a bottom portion of a midship of the hull to extend downward from the hull, a rudder provided on a bottom portion of a stern of the hull, a mast provided on the hull to extend upward from the hull, sails connected to the mast, the hull, the keel, the rudder, the mast and the sails having relative dimensions which simulate an actual sailing boat, and a balancing weight comprising an auxiliary keel including a keel body to be detachable attached to and extend downward from the bottom of the hull and a balancing mass provided on a lower end portion of the keel body for up-and-down movement relative to the keel body.

15 Claims, 5 Drawing Sheets

SAILING BOAT MODEL ADAPTED FOR EXHIBITION AND FOR SAILING ON THE WATER

BACKGROUND OF THE INVENTION

1. Field of the Invention

The present invention relates to a sailing boat model having auxiliary members which are detachably connected on the model, and more specifically to a sailing boat model which can be sailed on the water by mounting auxiliary members on the hull body of the model adapted for exhibition.

2. Description of the Prior Art

A sailing boat model, for example a yacht model, adapted for exhibition, which has a configuration similar to an actual sailing boat that is pars of the model such as a hull, a mast, a rudder, etc. have relative dimensions which simulate an actual sailing boat, is apt to turn over on its side as the weight of its sail is large compared with the size of the hull of the model. Moreover, the rudder area of the model is small compared with the weight of the model so that sufficient maneuverability can not be obtained.

A sailing boat model adapted for exhibition must have a configuration similar to an actual sailing boat. But the sail area of the model is small compared with the weight of the model so that, when the wind is gentle, the model can not sail unless the weight of the model is reduced. On the contrary, if the weight of the model is reduced, the model is apt to sway under a strong wind and to turn over on its side.

As described above, the sailing boat model adapted for exhibition is not suitable for actual sailing on the water. As a result, a sailing boat model adapted for actual sailing must have a configuration remarkably different from that of a model adapted for exhibition.

SUMMARY OF THE INVENTION

It is therefore the object of the present invention to provide a sailing boat model which is adapted for exhibition and also adapted for actual sailing on the water.

In accordance with the present invention, there is provided a sailing boat model adapted for exhibition and for actual sailing on water, comprising a hull, keel means provided on a bottom portion of a midship of the hull to extend downward from the hull, rudder means provided on a bottom portion of a stern of the hull, mast means provided on the hull to extend upward from the hull, sail means connected to the mast means, the hull, the keel means, the rudder means, the mast means and the sail means having relative dimensions which simulate an actual sailing boat, and balancing weight means detachably attached to the bottom portion of the midship of the hull to lower a center of gravity of the sailing boat model when it is sailed on the water.

In a preferable embodiment of the present invention, the balancing weight means comprises auxiliary keel means including keel body means to extend downward from the bottom of the hull and having balancing mass means provided on a lower end portion of the keel body means.

In another preferable embodiment of the present invention, the model further comprises adjusting means to adjust a posision of the balancing mass means along a line extending toward a bow of the sailing boat model with an up-grade.

In still another preferable embodiment of the present invention, said model further comprises stabilizing fin means provided on a lower end of the keel body means.

In another preferable embodiment of the present invention, said model further comprises auxiliary buoyant means provided on an upper part of the keel body means.

In still another preferable embodiment of the present invention, said model further comprises annular wire means provided on a fore end of the keel body means.

In a preferable aspect of the present invention, there is provided a sailing boat model adapted for exhibition and for actual sailing on water, comprising a hull, keel means provided on a bottom portion of of a midship of the hull to extend downward from the hull, rudder means provided on a bottom portion of a stern of the hull, mast means provided on the hull to extend upward from the hull, sail means connected to the mast means, the hull, the keel means, the rudder means, the mast means and the sail means having relative dimensions which simulate an actual sailing boat, and auxiliary rudder means detachably attached to the rudder means.

In a preferable embodiment of the present invention, at least a part of the auxiliary keel means and at least a part of the auxiliary rudder means are made of a transparent material.

According to the features of the present invention, a sailing boat model which has a configuration similar to an actual sailing boat and is adapted for exhibition is provided. When the model is sailed on the water, balancing weight means is detachably attached to the bottom portion of the midship of the hull so as to increase the stability of the model against rolling. Provided the balancing weight means comprises auxiliary keel means including keel body means to extend downward from the bottom of the hull and having balancing mass means provided on a lower end portion of the keel body means, the keel body means prevents the model from swaying, while the balancing mass means increases the stability of the model against rolling. Thus the model can sail on the water. The auxiliary rudder means helps to improve the model's ability to maintain its course. When the wind is strong, the model rolls excessively so that the center of the wind force acting on the sail means moves toward the stern of the model and thus it does not coincide with the yaw axis of the model any more. As a result, the model turns windward, and thus the model can not maintain its course any more. In accordance with the present invention, there is provided adjusting means to adjust the position of the balancing mass means along a line extending toward a bow of the sailing boat model with an up-grade so as to prevent such an above phenomenon from occuring. When the wind is strong, the balancing mass means provided on the lower end of the keel body means is lowered. Thus the position of the balancing mass means moves downward, which increases the stability of the model against rolling, and at the same time, the position of the balancing mass means moves toward the stern of the model, which causes the aft trim of the model to increase and causes the yaw axis of the model to move tward the stern of the model. As a result, the yaw axis of the model coincides with the center of the wind force acting on the sail, and thus the model has improved ability to maintain its course. Stabilizing fin means provided on the lower end of the keel body means decreases the pitching and the rolling of the model so that the sailing speed of the model is kept high. The auxiliary buoyant means provided on an upper part of the keel body means keeps a proper model draft so that the hydraulic resistance on the hull of the model decreases. The auxiliary buoyant means also increases the stability of the model against rolling. The auxiliary rudder means detachably attached to the rudder means compensates for the insufficient rudder area of the model so that the maneuverability of the model is improved. The annular wire means provide on a fore end of the keel body means operates as follows. When the annular wire means contacts with an obstacle during the sailing of the model on the water, the model turns around the contact point between the annular wire means and the obstacle so that the model can easily get away from the obstacle. The sailing boat model becomes even more similar to an actual sailing boat even if it is provided with the auxiliary keel means or the auxiliary rudder means if at least a part of the auxiliary keel means or the auxiliary rudder means is made of a transparent material, as they then could not be seen in the water.

The above and other objects and features of the present invention will become apparent from the following description of the preferred embodiments when taken in conjunction with the acocompanying drawings.

DESCRIPTION OF THE PREFERRED EMBODIMENTS

Figure 1:
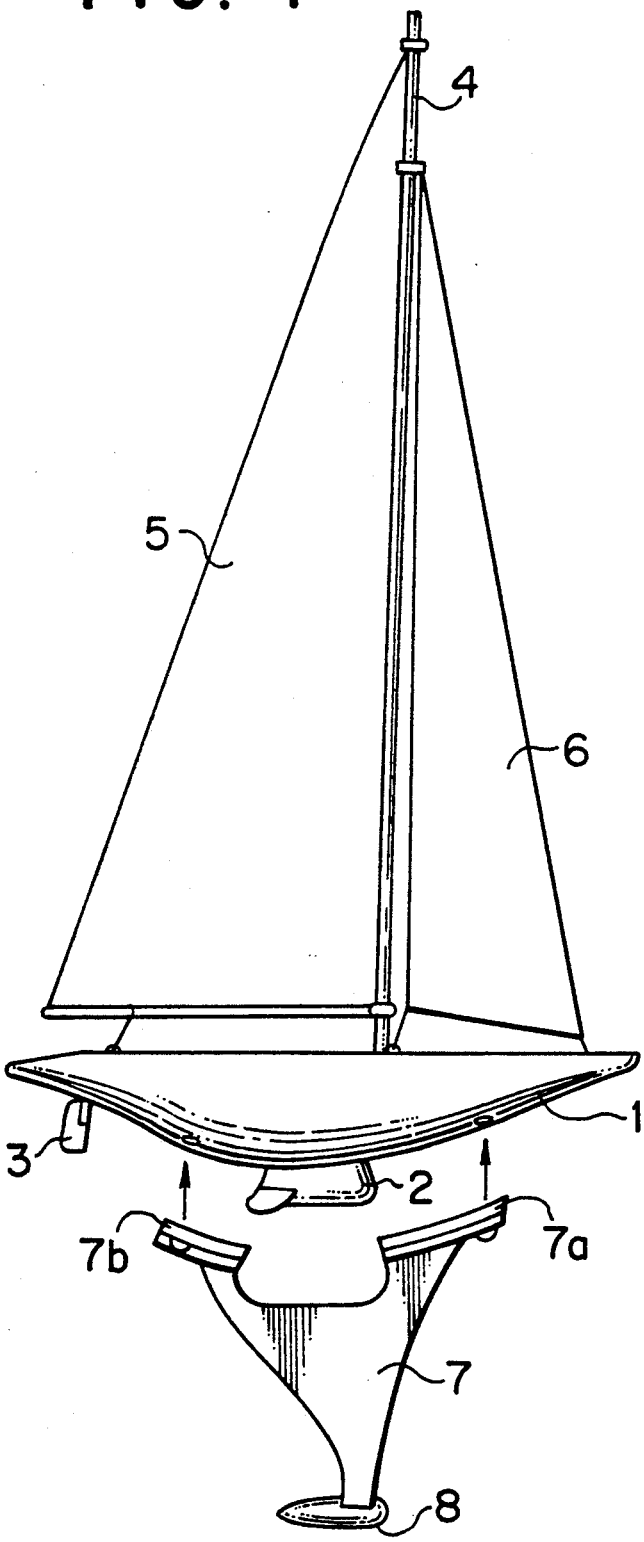
FIG. 1 is a side view showing a yacht model in accordance with an embodiment of the present invention.
Figure 2:
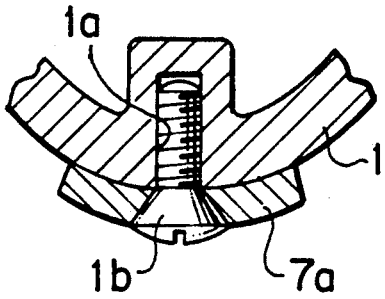
FIG. 2 is a cross sectional view of a part connecting the auxiliary keel to the hull of the model.

Referring to FIG. 1, there is shown a yacht model. The yacht model has a hull 1, and keel 2 provided on the bottom of the midship portion of the hull 1, and a rudder 3 provided on the bottom of the stern portion of the hull 1. The hull 1 is provided with a mast 4 extending upward. The mast 4 is provided with a main sail 5 at its rear side, and a jib sail 6 at its front side. The above mentioned model has a configuration similar to that of an actual yacht, that is the hull 1, the keel 2, the rudder 3, the mast 4, the sails 5 and 6 have relative dimension which simulate an actual sailing yacht. The model is exhibited on a proper base frame or hung on a wall. When the model is sailed on the water, an auxiliary keel 7 having a weight 8 on its lower end is provided so as to prevent the hull 1 from turning over on its side. The auxiliary keel 7 has connecting members 7*a*, 7*b*, each having a flange-like configuration, at its upper portion, and a cutout disposed between the connecting members 7*a*, 7*b* for preventing the auxiliary keel 7 from interfering with the keel 2. As shown in FIG. 2, the auxiliary keel 7 is mounted on the hull 1 by screwing connecting screws 1*b* into tapped holes 1*a* provided on the bottom of the hull 1 and each having a construction of a cap nut for waterproofing, so as to fix the flange-like connecting members 7*a*, 7*b* on the hull 1 from its outside along the center line of the hull 1 with the cutout between connecting members 7*a*, 7*b* facing the keel 2. Thus, the auxiliary keel 7 can be easily connected to and disconnected from the hull 1.

Figure 3A:
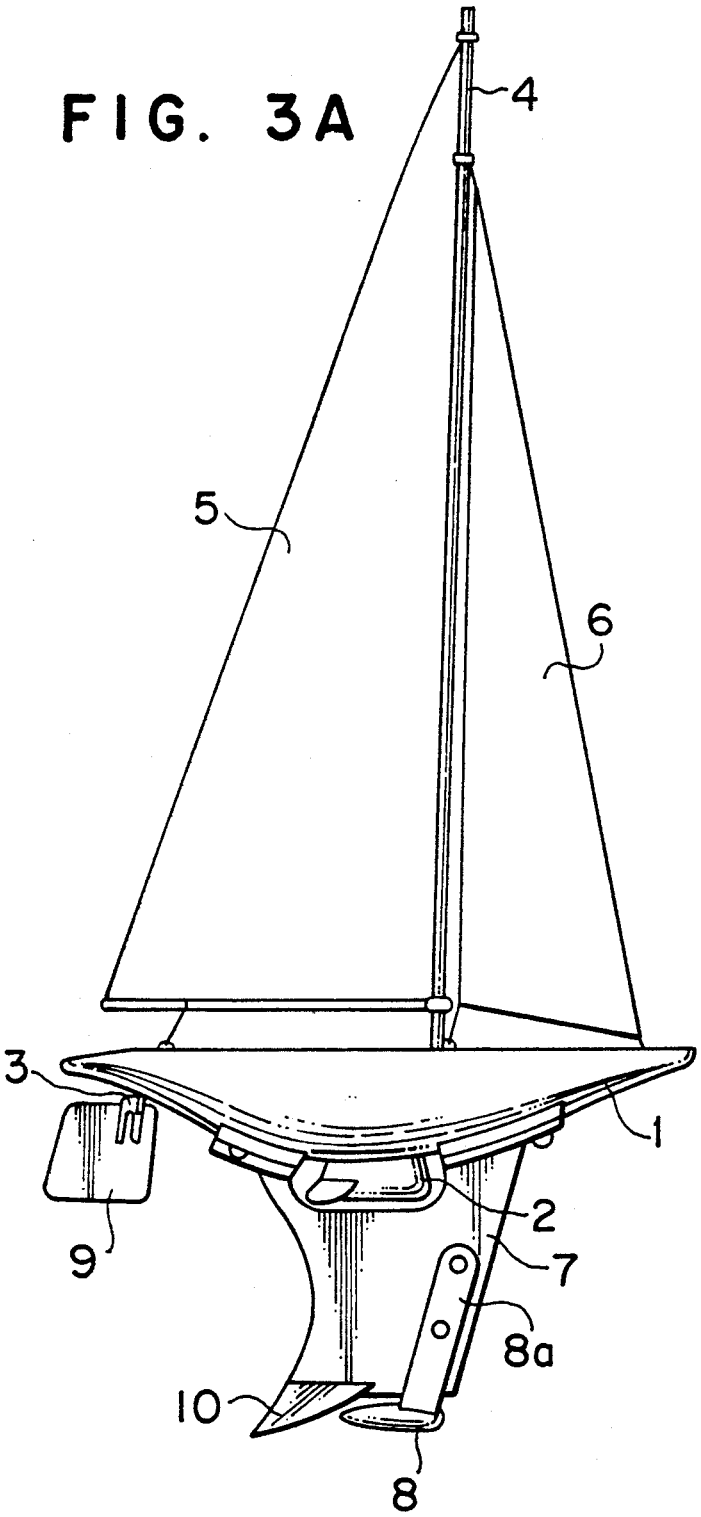
FIG. 3A is a side view showing a yacht model in accordance with another embodiment of the present invention.
Figure 3B:
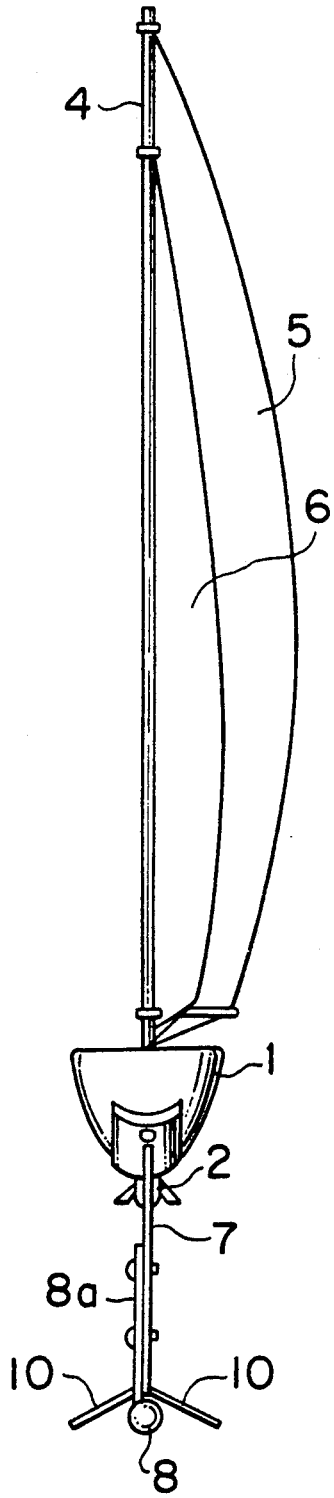
FIG. 3B is a front view of the model in FIG. 3A.
Figure 4:
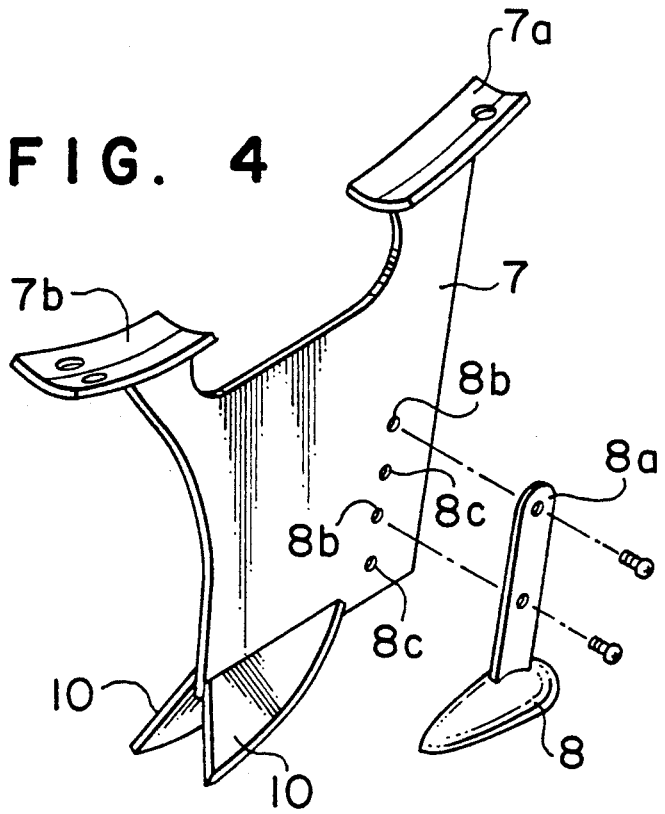
FIG. 4 is a perspective view showing a procedure for connecting the weight to the auxiliary keel in the embodiment of FIG. 3A.
Figure 5:
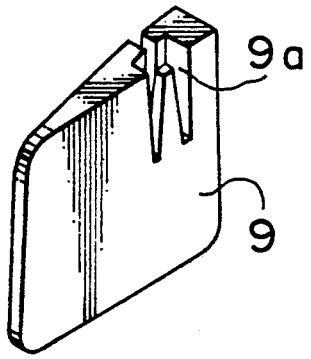
FIG. 5 is a perspective view showing an auxiliary rudder in accordance with the present invention.
Figure 6:
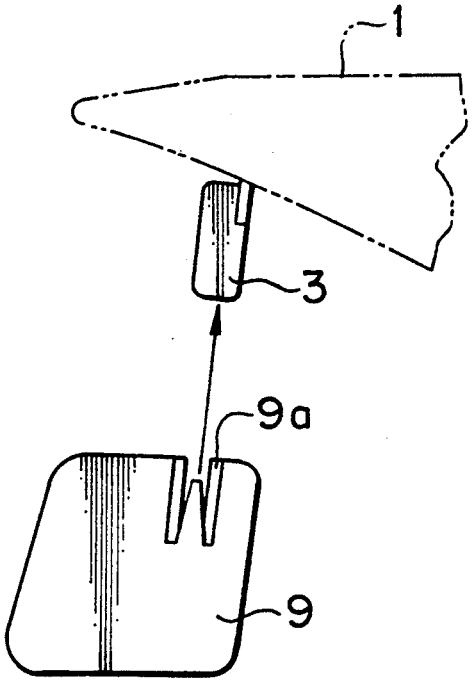
FIG. 6 is a side view showing a procedure for connecting the auxiliary rudder of FIG. 5 to the rudder of the model.

FIGS. 3A, 3B show another embodiment of the present invention. In this embodiment, the auxiliary keel 7 is provided with stabilizing fins 10, 10 on both sides of the lower end of its rear portion. Fixed to the fore part of the auxiliary keel 7 is a connecting member 8*a* which is adapted to hold the weight 8 and is able to adjust the height at which the weight 8 is mounted to the keel 7. By this construction, the stabilizing fins 10, 10 and the weight 8 can be used a tripod to make the model stand up straight, with the auxiliary keel 7 being mounted on the hull 1. As shown in FIG. 4, the connecting member 8*a* is mounted to the fore part of the auxiliary keel 7 by screwing the connecting member 8*a* on the fore part of the auxiliary keel 7 using a pair of upper tapped holes 8*b*, 8*b* or a pair of lower tapped holes 8*c*, 8*c* which are disposed on the auxiliary keel 7 along the leading edge of the keel 7, in accordance with the height at which the weight 8 is to be mounted on the keel 7. Thus, the height at which the weight 8 is mounted to the keel 7 can be adjusted. Moreover, the leading edge of the keel 7 is inclined to form a line extending toward a bow of the model with an up-grade as shown in FIG. 3A so that the position of the weight 8 moves toward the stern of the model 1 as the position of the weight 8 moves downward. As shown in FIGS. 5 and 6, an auxiliary rudder 9 is connected to the rudder 3 by inserting the rudder 3 into a channel 9*a* disposed on the upper portion of the auxiliary rudder 9. Maneuverability of the model yacht is improved by using the auxiliary rudder 9.

Figure 7A:
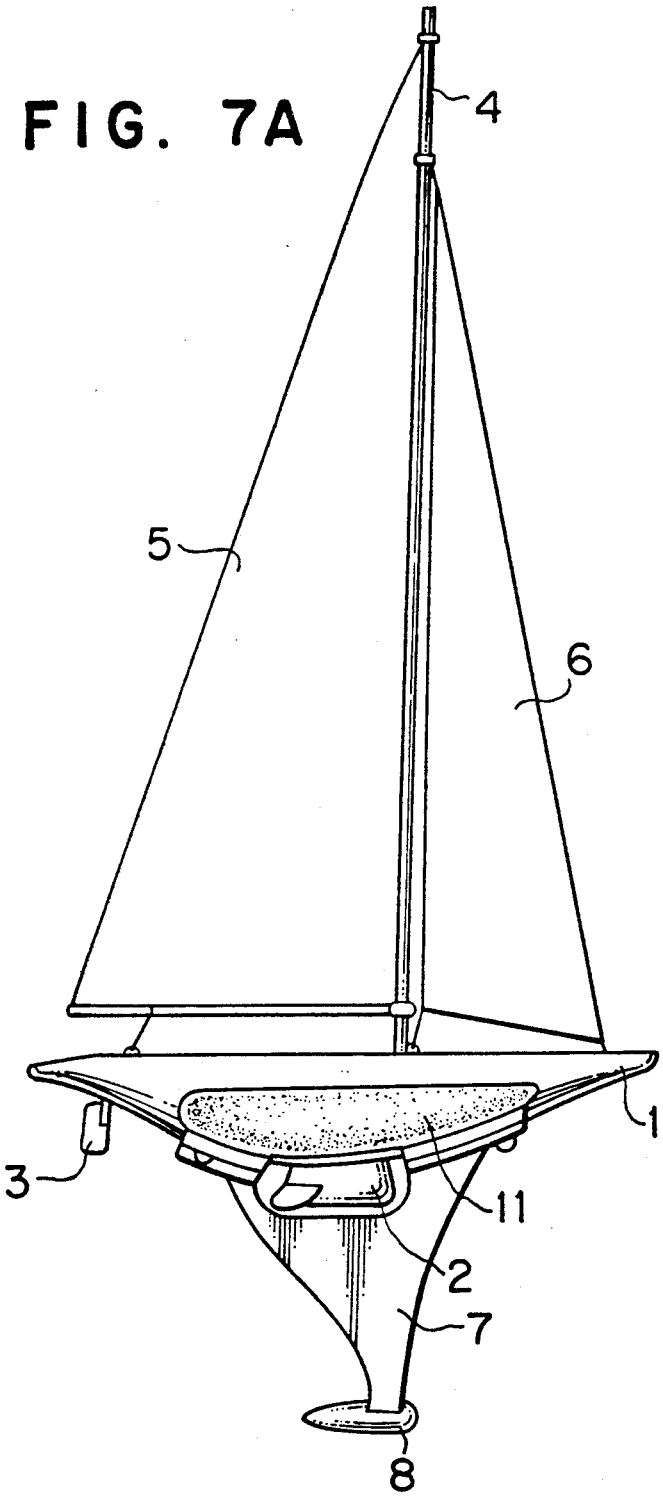
FIG. 7A is a side view showing another embodiment of the present invention which is provided with the auxiliary buoyant means.
Figure 7B:
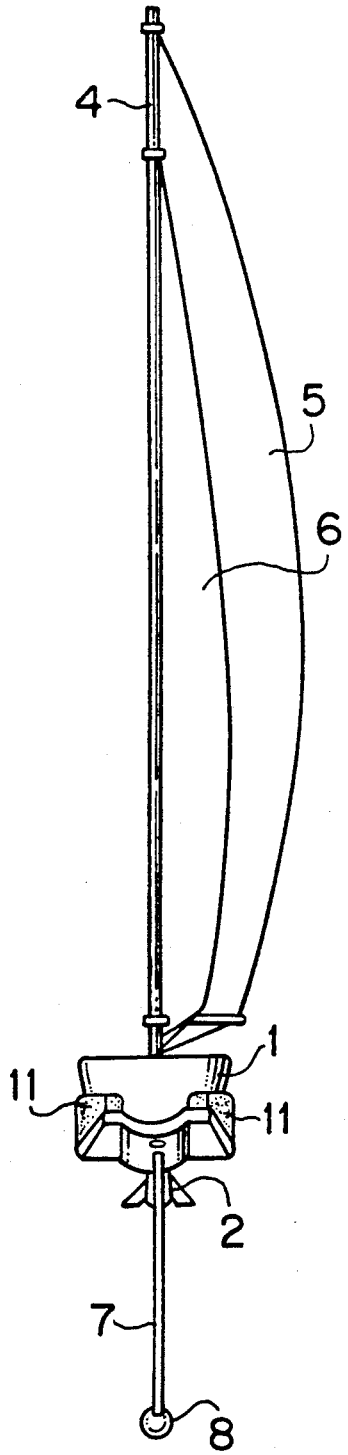
FIG. 7B is a front view of the model in FIG. 7A.

FIGS. 7A, 7B show still another embodiment of the present invention. In this embodiment, the auxiliary keel 7 is provided with auxiliary buoyant means 11 made of a foaming material on both sides of its upper portion. By this construction, the yacht model draft becomes shallow so that the hydraulic resistance of the hull 1 becomes small, and at the same time, stability against rolling by a strong wind increases. The auxiliary buoyant means 11 may be made of a hollow material.

Figure 8:
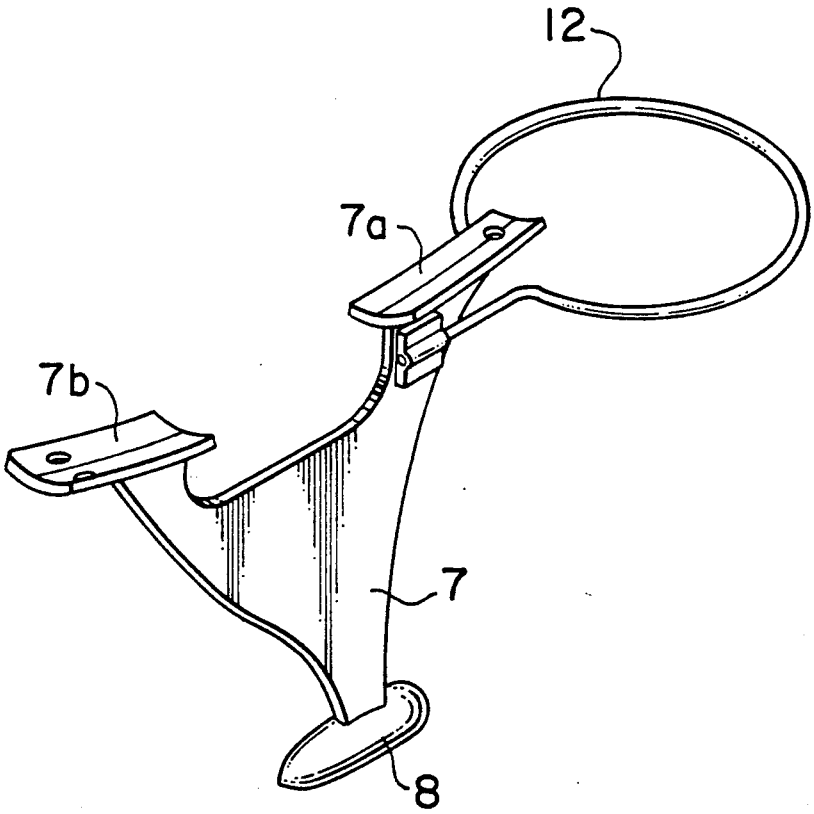
FIG. 8 is a perspective view showing another embodiment of the present invention which is provided with the annular wire at its auxiliary keel.

FIG. 8 shows still another embodiment of the present invention. In this embodiment, the auxiliary keel 7 is provided with an annular wire 12 on its fore end. By this construction, when the annular wire 12 contacts with an obstacle during the sailing of the yacht model on the water, the yacht model turns around the contact point between the annular wire 12 and the obstacle so that the yacht model can easily get away from the obstacle.

In the aforementioned embodiments, the yacht model becomes even more similar to the actual yacht even if it is provided with the auxiliary keel 7 and the auxiliary rudder 9 if the auxiliary keel 7 and the auxiliary rudder 9 are made of a transparent material such as transparent plastic, as they then could not be seen in the water.

We claim:

1. A sailing boat scale model adapted for exhibition and for actual sailing on water, comprising:

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, keel, rudder, mast and sail having relative dimensions which simulate an actual sailing boat; and, auxiliary means to allow the scale model to sail on water including a keel body to be detachably attached to and extend downward from the bottom of the hull during such sailing, and a balancing mass provided on a lower end portion of the keel body for up and down movement relative to the keel body.

2. A sailing boat scale model adapted for exhibition and for actual sailing on water; comprising;

a hull;

a keel provided on a bottom portion of a midship of the hull to extend downward from the hull;

a rudder provided on a bottom portion of a stern of the hull;

a mast provided on the hull to extend upward from the hull;

a sail connected to the mast means;

the hull, keel, rudder, mast and sail having relative dimensions which simulate an actual sailing boat; and, auxiliary means to allow the scale model to sail on water including a keel body to be detachably attached to and extend downward from the bottom of the hull, a balancing mass provided on a lower end portion of the keel body, and adjusting means to adjust both an up and down position and a fore-and-aft position of the balancing mass relative to the keel body along a line extending with an up-grade toward a bow of the sailing boat model.

3. A sailing boat scale model in accordance with claim 2, further comprising:

fin means provided on the lower end portion of the keel body means for stabilizing the model during sailing and positioned to cooperate with the balancing mass for holding the model upright on uneven ground.

4. A sailing boat scale model in accordance with claim 2, further comprising:

auxiliary rudder means detachably attached to the rudder for augmenting steering of the model during such sailing.

5. A sailing boat scale model adapted for exhibition and for actual sailing on water, comprising:

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, keel, rudder, mast and sail having relative dimensions which simulate an actual sailing boat;

auxiliary means to allow the scale model to sail on water including a keel body to be detachably attached to and extend downward from the bottom of the hull during such sailing, a balancing mass provided on a lower end portion of the keel body, adjusting means to adjust both an up and down position and a fore-and-aft position of the balancing mass relative to the keel body along a line extending with an up-grade toward a bow of the sailing boat model, and means provided on an upper part of the keel body for providing additional buoyancy during such sailing.

6. A sailing boat scale model adapted for exhibition and for actual sailing on water; comprising:

a hull;

a keel provided on a bottom portion of a midship of the hull to extend downward from the hull;

a rudder provided on a bottom portion of a stern of the hull;

a mast provided on a hull to extend upward from the hull;

a sail connected to the mast;

the hull, keel, rudder, mast and sail having relative dimensions which simulate an actual sailing boat;

auxiliary means to allow the scale model to sail upon the water including a keel body to be detachably attached to and extend downward from the bottom of the hull during such sailing a balancing mass provided on a lower end portion of keel body, adjusting means to adjust both an up and down position and a fore-and-aft position of the balancing mass relative to the keel body along a line extending with an up-grade toward a bow of the sailing boat model, stabilizing fin means provided on the lower end portion of the keel body means for stabilizing the model during such sailing, and means provided on an upper part of the keel body means for providing additional buoyancy during such sailing.

7. A sailing boat scale model adapted for exhibition and for actual sailing on water, comprising;

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, keel, rudder, mast and sail having relative dimensions which simulate an actual sailing boat;

auxiliary means to allow the scale model to sail on water including a keel body to be detachably attached to and extend downward from the bottom of the hull during such sailing, a balancing mass provided on a lower end portion of the keel body, adjusting means to adjust both an up and down position and a fore-and-aft position of the balancing mass relative to the keel body along a line extending with an up-grade toward a bow of the sailing boat model, means detachably attached to the rudder during such sailing for augmenting steering of the scale model during such sailing, and auxiliary buoyant means provided on an upper part of keel body for providing additional buoyancy during such sailing.

8. A sailing boat scale model adapted for exhibition and for actual sailing on water, comprising:

a hull;

a keel provided on a bottom portion of a midship of the hull to extend downward from the hull;

a rudder eans provided on a bottom portion of a stern of the hull;

a mast provided on the hull to extend upward from the hull;

a sail connected to the mast;

the hull, keel, rudder, mast and sail having relative dimensions which simulate an actual sailing boat;

auxiliary means to allow the scale model to sail on water including a keel body to be detachably attached to and extend downward from the bottom of the hull during such sailing, a balancing mass provided on a lower end portion of keel body, adjusting means to adjust both an up and down position and a fore-and-aft position of the balancing mass relative to the keel body along a line extending with an up-grade toward a bow of the sailing boat model, and annular wire means provided on a fore end of the keel body means during such sailing for turning the model about obstacles during such sailing.

9. A sailing boat scale model adapted for exhibition and for actual sailing on water, comprising;

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, keel, rudder, mast and sail having relative dimensions which simulate an actual sailing boat;

auxiliary means to allow the scale model to sail on water including a keel body detachably attached to and extend downward from the bottom of the hull during such sailing, a balancing mass provided on a lower end portion of the keel body, adjusting means to adjust both an up and down position and a fore-and-aft position of balancing mass means relative to keel body means along a line extending with an up-grade toward a bow of the sailing boat model, fin means provided on the lower end portion of the keel body means for stabilizing the model during such sailing, and annular wire means provided on a fore end of the keel body means for turning the model about obstacles during such sailing.

10. A sailing boat scale model adapted for exhibition and for actual sailing on water, comprising:

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, keel, rudder, mast and sail having relative dimensions which simulate an actual sailing boat;

auxiliary means including keel body to be detachably attached to and extend downward from the bottom of the hull during such sailing, a balancing mass provided on a lower end portion of the keel body, adjusting means to adjust both an up and down position and a fore-and-aft position of the balancing mass relative to the keel body along a line extending with an up-grade toward a bow of the sailing boat model, auxiliary rudder means detachably attached to the rudder during such sailing for augmentng steering the model during sailing, and annular wire means provided on a fore end of the keel body means for turning the model about obstacles during such sailing.

11. A sailing boat scale model in accordance with claim 5, further comprising:

annular wire means provided on a fore end of the keel body means for turning the model about obstacles during such sailing.

12. A sailing boat scale model in accordance with claim 6, further comprising:

annular wire means provided on a fore end of the keel body means for turning the model about obstacles during such sailing.

13. A sailing boat scale model in accordance with claim 7, further comprising:

annular wire means provided on a fore end of the keel body means for turning the model about obstacles during such sailing.

14. A sailing boat scale model adapted for exhibition and for actual sailing on water, comprising:

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, keel, rudder, mast and the sail having relative dimensions which simulate an actual sailing boat; and, auxiliary means to allow the scale model to sail on water including a keel body to be detachably attached to and extend downward from the bottom of the hull during such sailing, a balancing mass means provided on a lower end portion of keel body, and adjusting means to adjust both an up and down position and a fore-and-aft position of balancing mass relative to the keel body along a line extending with an up-grade toward a bow of the sailing boat model;

at least a part of said auxiliary means being of a transparent material for minimizing interference with exhibition of the model to scale during sailing.

15. A sailing boat scale model adapted for exhibition and for actual sailing on water, comprising:

a hull;

a keel provided on a bottom portion of a midship of the hull to extend downward from the hull;

a rudder provided on a bottom portion of a stern of the hull;

a mast provided on the hull to extend upward from the hull;

a sail connected to the mast;

the hull, the keel, the rudder, the mast and the sail having relative dimensions which simulate an actual sailing boat;

auxiliary means to allow the scale model to sail on water including a keel body to be detachably attached to and extend downward from the bottom of the hull during such sailing, a balancing mass provided on a lower end portion of keel body, adjusting means to adjust both an up and down position and a fore-and-aft position of balancing mass relative to the keel body along a line extending with an up-grade toward a bow of the sailing boat model, and auxiliary rudder means detachably attached to the rudder during such sailing for augmenting steering of the scale model during such sailing;

at least a part of said auxiliary rudder means being of a transparent material for minimizing interference with exhibition of the model to scale during sailing.

* * * * *